US005113954A

United States Patent [19]

Hayashi et al.

[11] Patent Number: 5,113,954

[45] Date of Patent: May 19, 1992

[54] EXCAVATION TOOL

[75] Inventors: Takeshi Hayashi; Shigeru Sato; Katsuaki Tsujimoto; Daishiro Miyazaki; Yoneo Hiwasa, all of Gifu; Toshiki Ishimatsu, Tokyo, all of Japan

[73] Assignee: Mitsubishi Materials Corporation, Tokyo, Japan

[21] Appl. No.: 660,546

[22] Filed: Feb. 25, 1991

[30] Foreign Application Priority Data

| | | | |
|---|---|---|---|
| Feb. 28, 1990 | [JP] | Japan | 2-48233 |
| Feb. 28, 1990 | [JP] | Japan | 2-48234 |
| Mar. 14, 1990 | [JP] | Japan | 2-63821 |
| Nov. 2, 1990 | [JP] | Japan | 2-297943 |
| Nov. 2, 1990 | [JP] | Japan | 2-297946 |
| Nov. 6, 1990 | [JP] | Japan | 2-300283 |

[51] Int. Cl.[5] ..... E21B 10/36

[52] U.S. Cl. ..... 175/415; 175/296

[58] Field of Search ..... 173/48, 73, 78, 114, 173/109, 134, 136, 105, 17, 64; 175/71, 93, 96, 92, 296, 414, 415

[56] References Cited

U.S. PATENT DOCUMENTS

| | | | |
|---|---|---|---|
| 3,185,228 | 5/1965 | Kelly, Jr. | 175/415 |
| 3,682,258 | 8/1972 | Kelly, Jr. et al. | 175/96 |
| 4,030,554 | 6/1977 | Kammerer et al. | 173/17 |
| 4,299,297 | 11/1981 | Lloyd | 175/415 |
| 4,312,412 | 6/1982 | Pillow | 173/13 |
| 4,932,483 | 6/1990 | Rear | 175/92 X |

FOREIGN PATENT DOCUMENTS

| | | | |
|---|---|---|---|
| 36847 | 6/1981 | European Pat. Off. . | |
| 3338577 | 4/1984 | Fed. Rep. of Germany | 175/415 |
| A63-11789 | 1/1988 | Japan . | |
| 550100 | 12/1942 | United Kingdom . | |
| 2132252 | 10/1983 | United Kingdom . | |

*Primary Examiner*—Ramon S. Britts
*Assistant Examiner*—Frank S. Tsay
*Attorney, Agent, or Firm*—Scully, Scott, Murphy & Presser

[57] ABSTRACT

An excavation tool, having a pair of insertion holes placed in the bottom surface of a device, which receives the impact force of a hammer and the rotational force of a hammer cylinder, at positions separated in a radial direction from the center of the device and symmetrical around this center as a center of rotation, also having block axles, one end of each of which is freely rotatably inserted into one of the insertion holes, and having blocks, which have a roughly semicircular shape with a diameter roughly equal to that of the device, into the lead end surfaces of which are set bits, and which have straight edge surfaces which are flat surfaces vertical with respect to the lead end surfaces, provided at the other end of the block axles and with the straight edge surfaces in mutual opposition; in an extended diameter state of the blocks, the blocks are moved in opposite directions along a radius of the device by rotating the blocks around the block axles, and the distance between the centers of the insertion holes provided in the bottom surface of the device and the center of this device is set at from 0.2 times the diameter of the bottom surface of the device to 0.3 times thereof.

13 Claims, 18 Drawing Sheets

| DIAMETER RATIO (D/1) | DEPTH OF EXCAVATION | REMARKS |
|---|---|---|
| 0.16 | AVERAGE 20M | BENDING OF NECK |
| 0.18 | AVERAGE 30M | BENDING OF NECK |
| 0.20 | AVERAGE 50M | BENDING OF NECK |
| 0.22 | AVERAGE 90M | BENDING OF NECK |
| 0.24 | AVERAGE 120M | BENDING OF NECK |
| 0.26 | AVERAGE 260M | BENDING OF NECK<br>BIT WEAR<br>DEVICE WEAR |
| 0.28 | AVERAGE 300M | DEVICE WEAR RESULTING FROM BIT WEAR |
| | GREATEST 530M | DEVICE WEAR RESULTING FROM BIT WEAR |
| 0.30 | AVERAGE 300M | DEVICE WEAR RESULTING FROM BIT WEAR |
| 0.32 | AVERAGE 200M | DEVICE WEAR RESULTING FROM BIT WEAR |
| 0.34 | AVERAGE 100M | DEVICE WEAR RESULTING FROM BIT WEAR |
| 0.36 | AVERAGE 25M | DAMAGE RESULTING FROM THE CRACKING OF THE DEVICE |

FIG.22

EXCAVATION TOOL

BACKGROUND OF THE INVENTION

1. Field of the Invention

The present invention relates to an excavation tool for use in the excavation of earth and sand such as digging of wells or the construction of foundation piling holes and likes.

2. Prior Art

Conventionally, an excavation tool such as that disclosed in Japanese Patent Application, 1st publication, No. 63-11789 for the excavation of earth and sand is known.

This excavation tool will be explained with reference to FIGS. 1 and 3. The rotational force of hammer cylinder 1 and the impact force of a hammer (not shown) driven by air pressure are imparted to device 2. Two axle holes 2*a* and 2*b* are provided, symmetrically with respect to the center of the bottom surface of device 2, in the bottom surface of device 2. Block axles 3*a* and 3*b* are inserted in these axle holes 2*a* and 2*b* rotatably around their axes. Blocks 5*a* and 5*b*, which have roughly semicircular forms with roughly the same diameter as device 2, and into the lead end surface of which a plurality of bits 4 . . . are set, are provided at the lead end part of block axles 3*a* and 3*b*. Straight edge surfaces 6*a* and 6*b* are provided on blocks 5*a* and 5*b* in mutual opposition. By straight edge surfaces is meant parts which are flat surfaces, vertical with respect to the lead end surface. In this excavation tool, when the device 2 rotates in the direction of excavation, the end of one of each of the blocks 5*a* and 5*b* projects beyond the outer circumference of device 2 by a fixed excavation amount, and and at this time the straight edge surfaces 6*a* and 6*b* of both blocks are in mutual contact and are displaced with respect to the center of device 2.

Furthermore, in this excavation tool, when device 2 rotates in the direction of excavation X by means of hammer cylinder 1, blocks 5*a* and 5*b* rotate about block axles 3*a* and 3*b* while receiving resistance to excavation, and one of the ends of each of straight edge surfaces 6*a* and 6*b* of the blocks 5*a* and 5*b* projects beyond the outer circumference of device 2 by a fixed amount. In addition, parts of the straight edge surfaces 6*a* and 6*b* are in contact, the rotation of blocks 5*a* and 5*b* is stopped; in this state, blocks 5*a* and 5*b* receive the rotational force of device 2, earth is excavated by means of bits 4 . . . , and in addition, downward progress is made by means of the impact force of the hammer.

At this time, the excavated earth and sand is separated from the lead end of the excavation tool by expelling from air holes 8*a* and 8*b* which are provided in the bottom surface of device 2 the compressed air which is expelled when the hammer piston within hammer cylinder 1 descends, and then this earth and sand is moved to within excavation pipe 9 by way of discharge groove 9*a* which is provided in device 2, and is then discharged upwardly.

The above excavation tool is inserted deeper into the earth as excavation progresses, so that if it is damaged while in this inserted and extended state, it is difficult to withdraw in order to effect repairs or to replace parts. Accordingly, in this type of excavation tool, a high degree of reliability is required so that no problems occur during excavation.

SUMMARY OF THE INVENTION

It is an object of the present invention to prevent damage to the excavation tool, and to increase reliability during use in the earth.

In the construction of the present invention, a pair of insertion holes are placed in the bottom surface of the device, which receives the rotational force of the hammer cylinder and the impact force of the hammer; the holes are placed at positions separated from the center of the device and symmetrically about this center as a center of rotation. One end of each of the block axles is inserted in a freely rotatable manner into these insertion holes, blocks, which have roughly semicircular forms with roughly the same diameter as the device, and into the lead end surface of which a plurality of bits are set, are provided at the lead end part of the block axles so that the straight edge surfaces thereof, which are flat surfaces vertical with respect to the lead end surfaces, are in mutual opposition. In the state of the excavation tool in which the diameter is extended by rotating the blocks about the block axles, thus moving the blocks in opposite directions along radii of the device, the distance between the centers of the insertion holes provided in the bottom surface of the device and the center of the device is set at from 0.2 to 0.3 times the diameter of the bottom surface of the device. Thus, the ratio (d/1) of the outer diameter (d) of the block axles and the distance (1) between the ends of the blocks when the diameter has been extended can be preferably set within a range of from 0.22 to 0.34. Accordingly, the strength of the block axles is preserved, the thickness of the parts of the device surrounding and supporting these block axles can be ensured and the strength thereof increased, damage during excavation can be prevented and reliability can be improved.

BRIEF DESCRIPTION OF THE DRAWINGS

FIG. 22 is a table that shows rsult by the digging test of the excavation tool of first preferred embodiment.

DETAILED DESCRIPTION OF THE PREFERRED EMBODIMENTS

Figure 1:
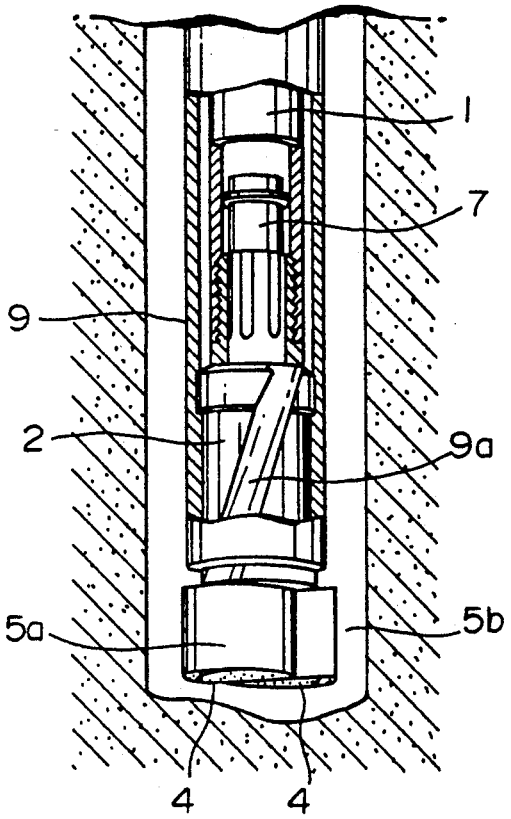
FIG. 1 is a cross-sectional diagram of an example of a conventional excavation tool.
Figure 2:
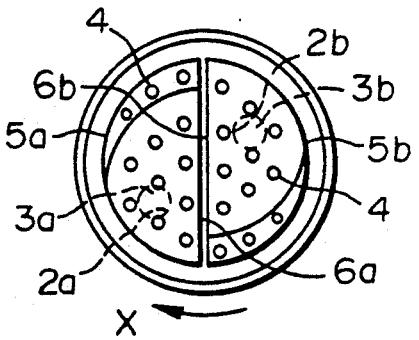
FIG. 2 is a plan view of the excavation tool shown in FIG. 1 in the state in which the bottom surface of the blocks are retracted.
Figure 3:
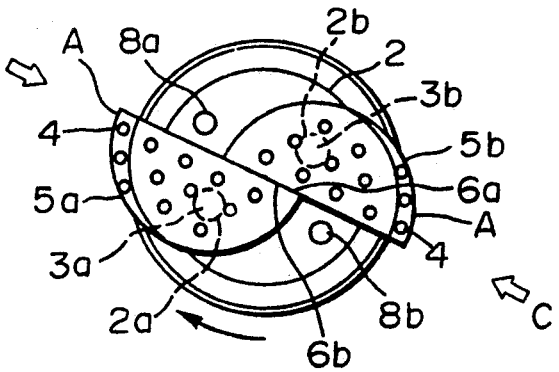
FIG. 3 is a plan view of the part shown in FIG. 2 in the extended state.

FIGS. 4 to 21 show a first preferred embodiment of the present invention. Fundamentally, the excavation tool shown in the diagrams, like the excavation tool shown in FIGS. 1 and 3 has a basic construction such that block axles 20 are fitted, symmetrically with respect to the center of device 10 and in a freely rotatable manner about axes, into the bottom surface of device 10, which receives the impact of the hammer and the rotational force of the hammer cylinder; blocks 22, which are roughly semicircular, have diameters roughly equal to that of device 10 and into the lead edge surfaces of which are set bits 21, are provided at the lead edge part of block axles 20 with straight edge surfaces 22*a* thereof in opposition. The positions of the block axles 20 are caused to be eccentric with respect to the center of device 10 so that when device 10 is rotated in the direction of excavation, one edge part of each of the blocks 22 protrudes beyond the outer circumference of device 10 by a fixed excavating amount, and when the diameter of blocks 22 expands, the straight edge surfaces 22*a* of both blocks 22 are in contact.

Figure 4:
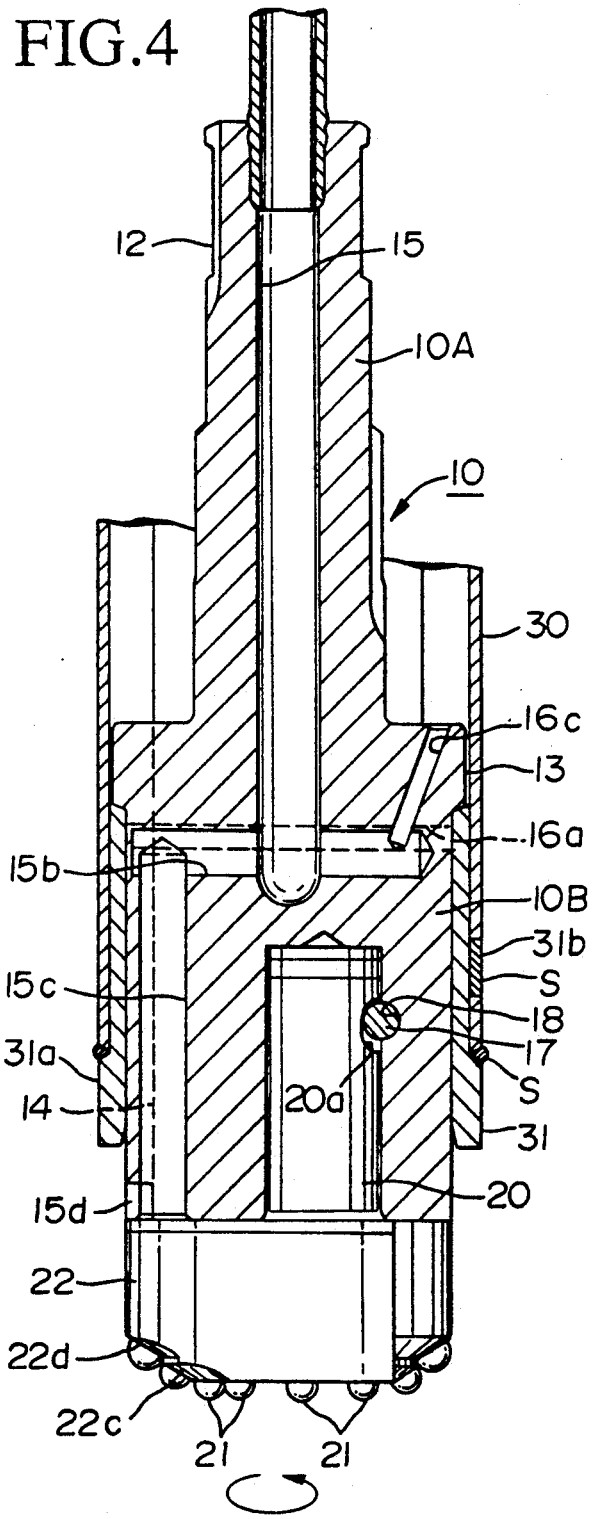
FIG. 4 is a cross-sectional diagram of the overall construction of the excavation tool of the first preferred embodiment.
Figure 6:
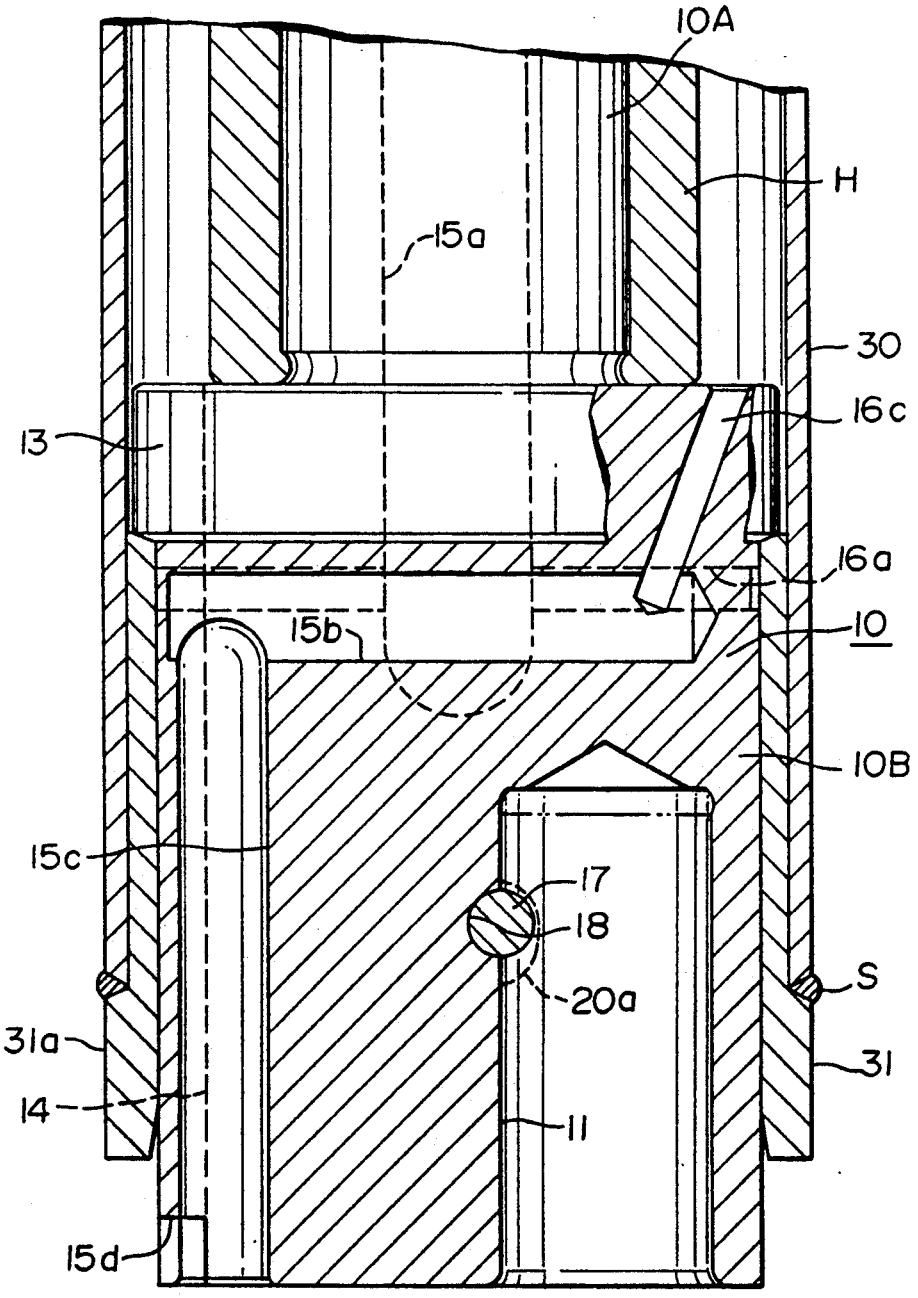
FIG. 6 is a cross-sectional view of the portion of the device shown in FIG. 1 in an extended state.
Figure 7:
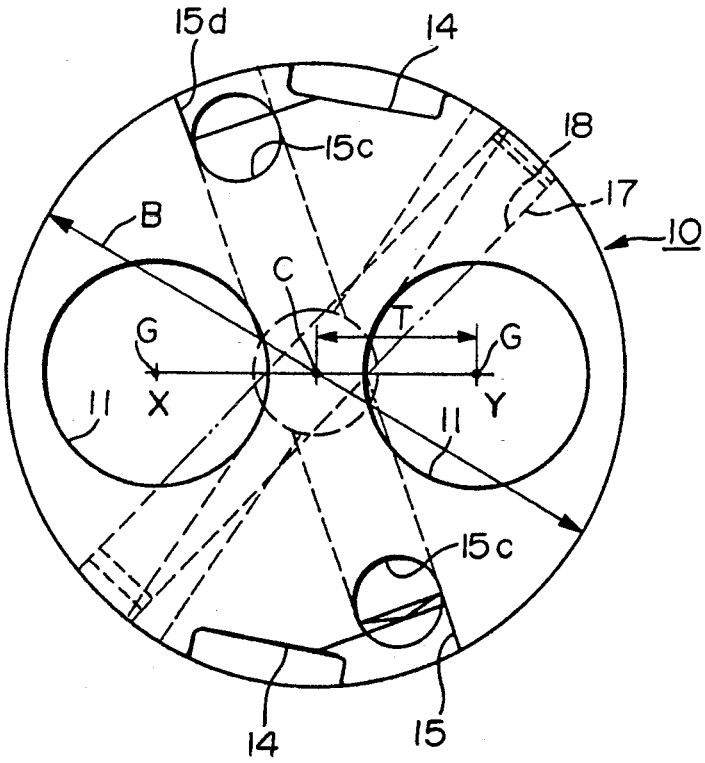
FIG. 7 is a plan view of the bottom surface of the device in the first preferred embodiment.
Figure 8:
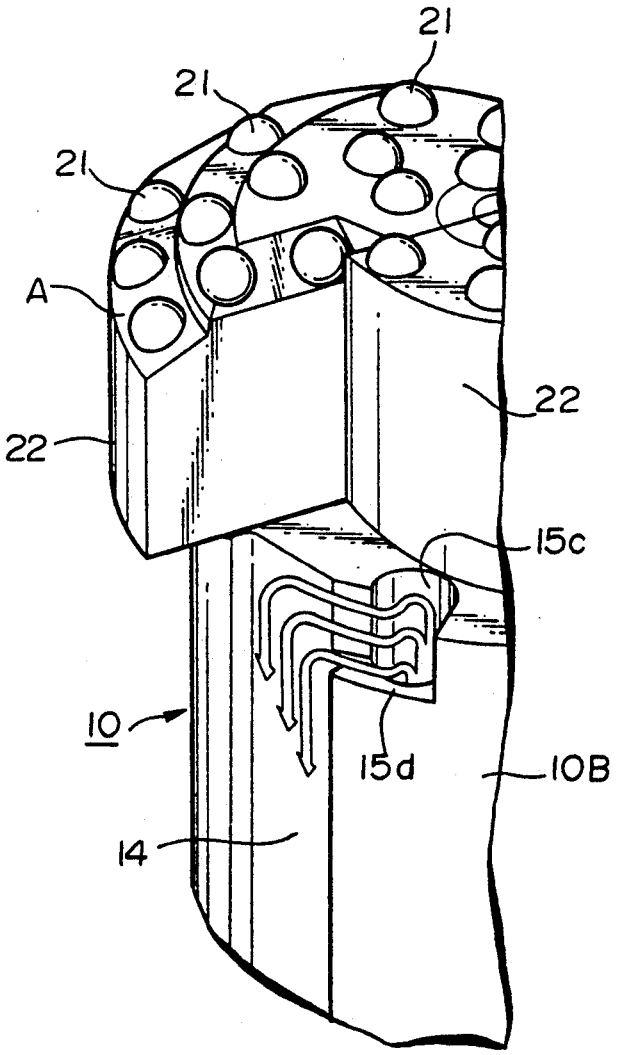
FIG. 8 is an angled view of the device and the blocks of the first preferred embodiment.

Hereinbelow, the main components of the excavation tool will be explained in detail. First, device 10 comprises largely, as shown in FIGS. 4 and 6, a small-diameter part 10A, which is provided with a spline groove 12 on the outer circumference thereof, and a large-diameter part 10B, which is provided with insertion holes 11, into which block axles 20 are inserted. On the outer circumference of large- diameter part 10B, a flange part 13, which engages a fastening pipe 31 which is provided on the inner circumference of the forward end of excavation pipe 30, is provided in a unitary manner, and a discharge groove 14 for the discharge of excavated material in an upward direction is formed.

In addition, in the center of device 10, an exhaust hole 15*a* is formed in a axial direction. This exhaust hole 15*a* is opened in the upper end of the inner diameter part of device 10, and compressed gas emitted when the hammer piston falls flows into the opening thereof. Furthermore, passage hole 15*b*, which connects to the lead end of exhaust hole 15*a* and extends to the outside in a radial direction, is formed, and air hole 15*c*, which extends from both ends of passage hole 15*b* to the lead end side of device 10, reaches the bottom surface of device 10 and has an opening there. In addition, notch 15*d*, which is connected to discharge groove 14 and air hole 15*c*, is provided between the bottom surface of device 10, where the lead end of air hole 15*c* is, and the outer circumference thereof.

Furthermore, circumference groove 16*a*, which extends for one loop around the outer circumference of device 10, is formed on the outer circumference of device 10, positioned near flange part 13 of device 10, and within device 10, passage hole 16*b* connecting circumference groove 16*a* and air holes 15*a* is provided (see FIG. 6).

In addition, flow hole 16*c* which extends to the upper surface of large-diameter part 10B of device 10 is formed at passage hole 15*b*, which is connected to discharge hole 15*a*, so as to relieve compression when air hole 15*c* is plugged and to insure that hammer H does not stop. This flow hole 16*c* is, as shown in FIG. 6, positioned on the outer side of hammer H; this flow hole is formed so as not to be blocked by hammer H when hammer H descends.

Insertion holes 11 are offset from the center of device 10 and formed symmetrically with respect to the center of device 10; more concretely, as shown in FIG. 4, the axial centers G thereof are provided at positions which are offset from the center position C of the bottom surface of the device by a distance T which is roughly from 0.2 to 0.3 taimes the diameter B of the device 10.

In addition, block axles 20 are inserted into insertion holes 11 in a rotatable and fastened manner on an axial dirrection; furthermore, the fastening of these block axles 20 is accomplished by, for example, inserting a engaging pin 17 from a pin hole 18 of device 10 while block axles 20 are inserted in insertion holes 11, and suspending the engaging pin 17 in notches 20*a*, which are formed in the outer circumference of block axles 20.

Next, to explain the construction of block axles 20 and blocks 22, these block axles 20 and blocks 22 are provided perpendicularly to each other, so that it is acceptable to form block axles 20 and blocks 22 in a unitary fashion, or to construct them separately and connect them by means of bolts or the like.

Figure 9:
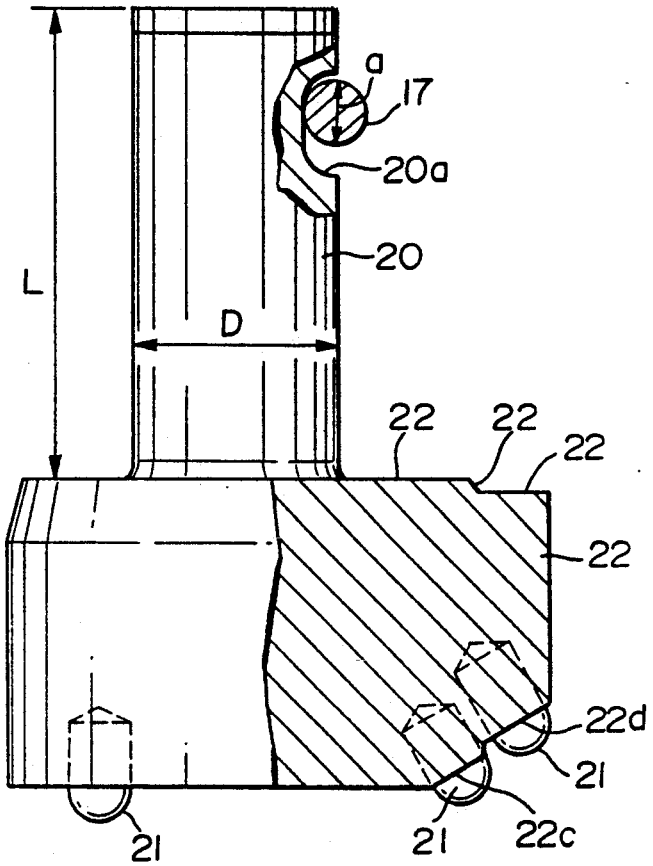
FIG. 9 is a front view of the block of the first preferred embodiment.
Figure 10:
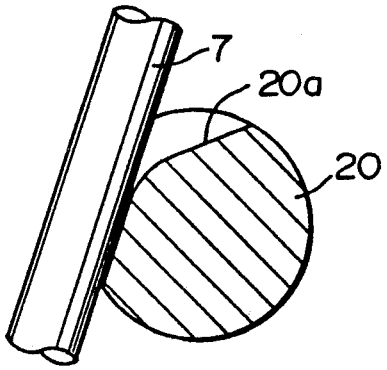
FIG. 10 is a cross-sectional view showing the state in which the engaging pin is engaged with the block axle in the first preferred embodiment.

More concretely, as shown in FIG. 9, block axles 20 are so formed that the length dimension L thereof is 1.5 to 2.5 times the outer diameter D of block axles 20. Furthermore, as shown in FIGS. 9 and 10, notches 20*a*, into which engaging pin 17 is inserted, are formed on the outer circumference of block axles 20. These notches 20 are constructed by notching the outer circumference of block axles 20 only at a position corresponding to the angle of rotation of blocks 22; furthermore, they are basically constructed by making notches in block axles 20 in the axial direction thereof which are longer than the diameter a of engaging pin 17. In actuality, notches 20*a* are set at roughly 3 times the outer diameter of engaging pin 17, more concretely, the size thereof is on the level of 4–8 mm.

Each block 22 is of an identical shape, formed with a fan shape (in the case of this preferred embodiment, a semicircular shape) when viewed from below; the radius of this fan has roughly the same value as the radius of the device 10. Blocks 22 have straight edge surfaces 22*a* facing each other and, moreover, have arc parts 22*b*, forming together a rough circle.

A first inclined surface 22*c*, which gradually slopes toward the axial direction base end side of device 10 as it extends outward, is formed on the outer circumference of the lead end surface (bottom surface) of blocks 22, and a second inclined surface 22*d*, which slopes toward the axial direction base end side of device 10 at a different angle of inclination from that of the first inclined surface 22*c*, is formed on the outer circumference of this first inclined surface 22*c*.

Figure 11:
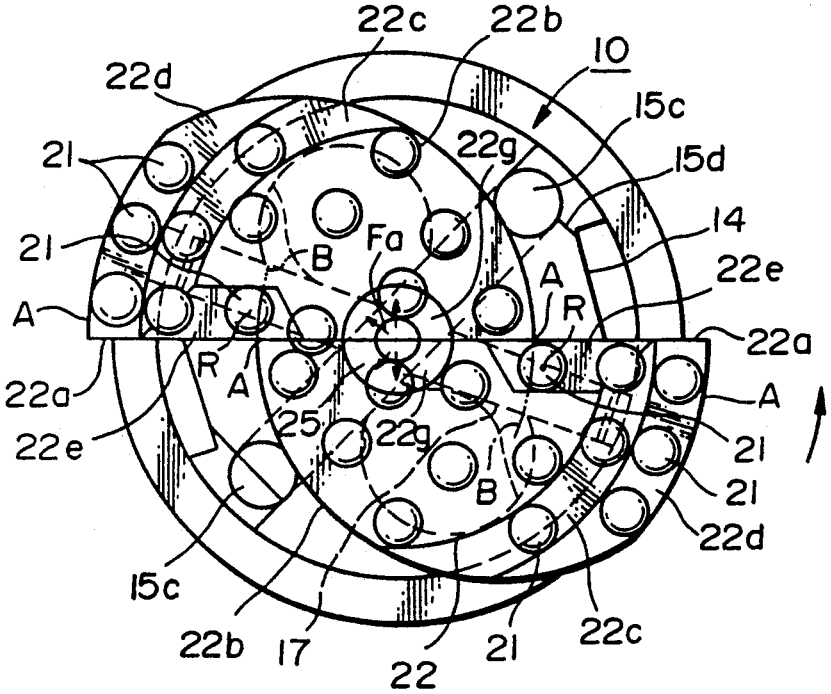
FIG. 11 is a plan view showing the state of the first preferred embodiment in which the blocks are extended.
Figure 12:
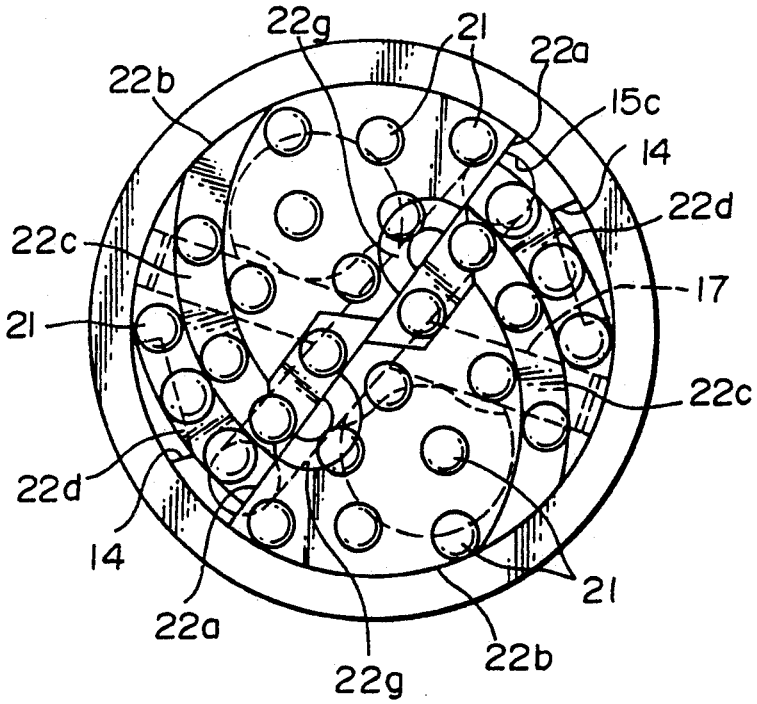
FIG. 12 is a plan view showing the state of the first preferred embodiment in which the blocks are retracted.
Figure 13:
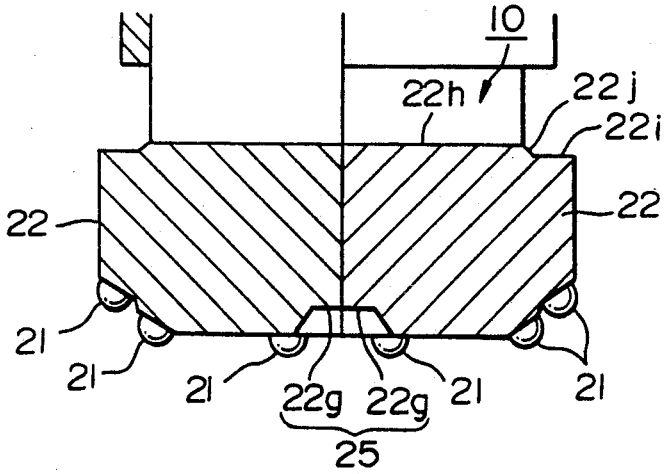
FIG. 13 is a cross-sectional view of the block of the first preferred embodiment.

Furthermore, when device 10 rotates in the direction of excavation, a third inclined surface 22*e*, which gradually slopes toward the axial direction base end side of device 10 as it proceeds in the direction of rotation, is formed at the end part of straight edge surfaces 22*a* of blocks 22, which straight edge surfaces project beyond the outer circumference of device 10 (see FIG. 11).

In addition, a plurality of bits 21 . . . comprising superhard chips are set into the lead end surface of blocks 22 as well as the first through third angled surfaces 22*c*, 22*d*, and 22*e* so that the bits are vertical with respect to the surfaces.

In this connection, in this preferred embodiment, a part of the bits 21 . . . are placed in the vicinity of the straight edge surfaces 22*a* of blocks 22 and are set in along the straight edge surfaces 22*a*. Among the bits 21 in the vicinity of the straight edge surfaces, the summits R of the bits 21 (in the present preferred embodiment, the bits on the third angled surface 22*e*) which are positioned further towards the outer side than the arc part 22*b* of one block 22 in the position in which one of the end parts of each of the blocks 22 protrudes beyond the outer circumference of device 10 by a fixed excavating amount are, as shown in FIG. 11, positioned to the outside of an extrapolated line A–B which extends along the curve of the outer surface of the blocks.

The previously mentioned lead end surface (bottom surface) of block 22 comprises a level surface 22*b*, which positioned on the side of block axles 20 and is perpendicular to block axles 20, a first sloping surface 22*c*, which is inclined with a downward slope in the direction of the outer circumference of device 10 from the arc-shaped ridge line of this level surface 22*b*, and a second sloping surface 22*d*, which is inclined with a downward slope in the direction of the outer circumference of device 10 from the arc-shaped ridge line of this first sloping surface 22*c*. Moreover, a step 22*f* is provided between the first sloping surface 22*c* and the second sloping surface 22*d*(see FIG. 18).

Furthermore, in the present preferred embodiment, concave parts 22*g*, which form concavity 25, which has the same center as device 10, in the center of the opposing blocks 22 when one end part of each block 22 protrudes beyond the outer circumference of device 10 by a fixed excavating amount, are provided between the bottom surface (lead end surface) of both blocks 22 and straight edge surfaces 22*a*. This concavity 25 comprises, in the present embodiment, a circular bottom part and a tapered surface which slopes as it extends upward from the bottom part; however, the present embodiment is not limited to a circular shape, and the shapes shown in FIGS. 11 and 12 would be acceptable.

Figure 14:
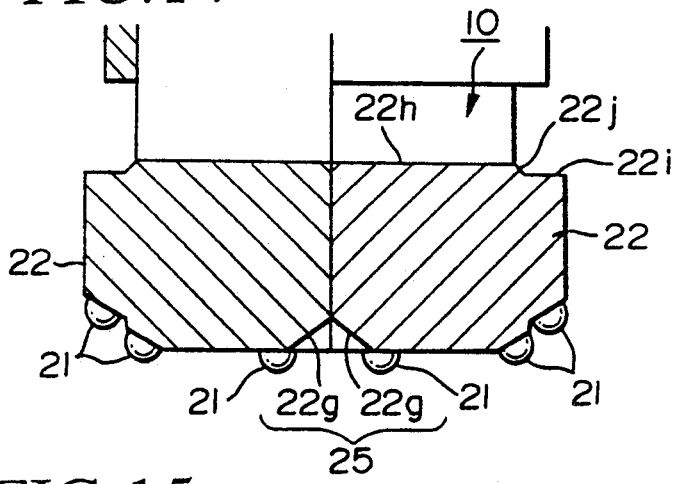
FIG. 14 is a cross-sectional view showing a modification of of the same portion shown in FIG. 13.
Figure 15:
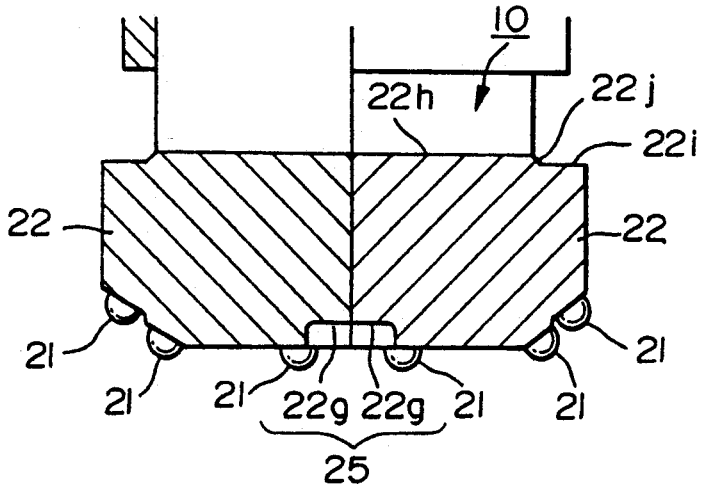
FIG. 15 is a cross-sectional diagram showing another modification of the same portion shown in FIG. 13.

In this connection, in FIG. 14, a shape is shown which is formed of a tapered surface along, and in FIG. 15, a shape is shown which has no tapered surface but rather a wall which extends essentially vertically upward from the bottom part.

At the surface of the blocks 22, there are a contact part 22*h* and a pre lowed part 22*i*. The contact part 22*h* can contact with the lower surface of device 10, either in extended state or non-extended state. There is an angled surface 22*j*, the beginning edge of which is at the same height as contact part 22*g* and the ending edge of which is at the same height as pre-lowered part 22*i*.

Figure 5:
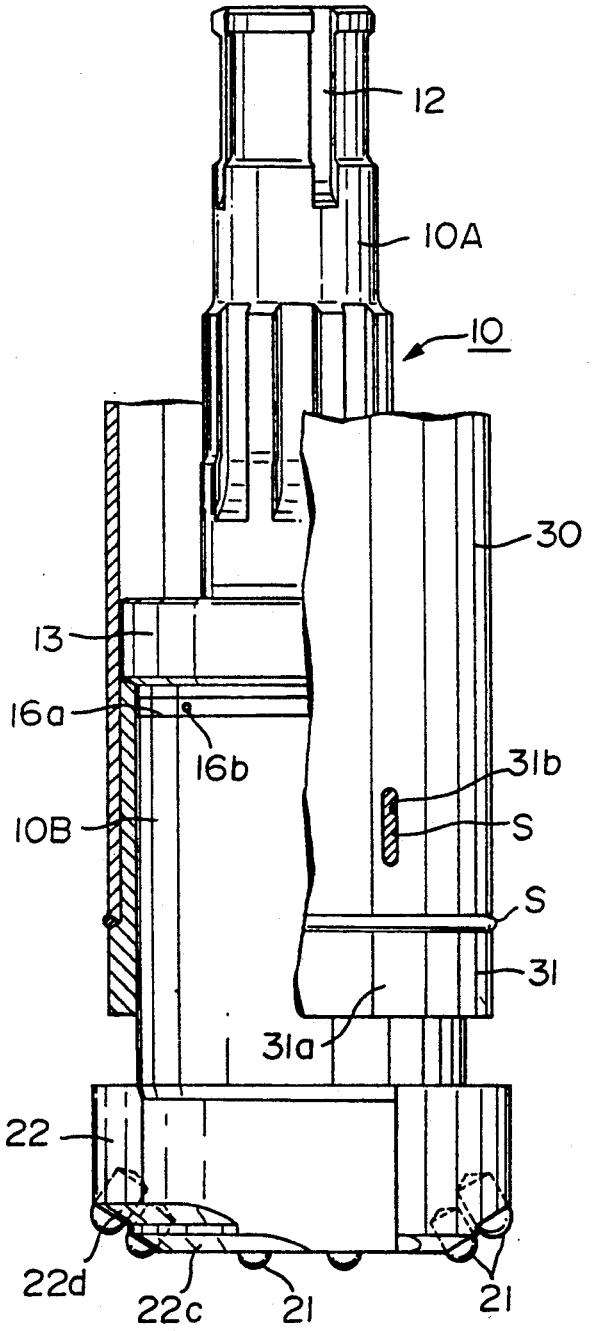
FIG. 5 is a partial cross-sectional view of the same part shown in FIG. 1.

Next, with regard to the construction of excavation pipe 30 and with reference to FIGS. 4 to 6, this has a round- pipe form of a size sufficient for the insertion of device 10 therein, and fastening pipe 31 is fastened integrally to the inner circumference of the lead end thereof.

A flange part 31*a* which is in contact with the lead end of excavation pipe 30 is provided in contact with the outer circumference of fastening pipe 31, and the flange part 31*a* is welded to the lead end of excavation pipe 30 over the entire circumference thereof by means of a welded part S. Furthermore, a notch hole 31*b* which extends in a radial direction of fastening pipe 31 and communicates the inside and outside of fastening pipe 31 is formed therein, and through the medium of this notch hole 31*b*, fastening pipe 31 and excavation pipe 30 are welded together in a unitary fashion by means of welded part S.

Figure 20:
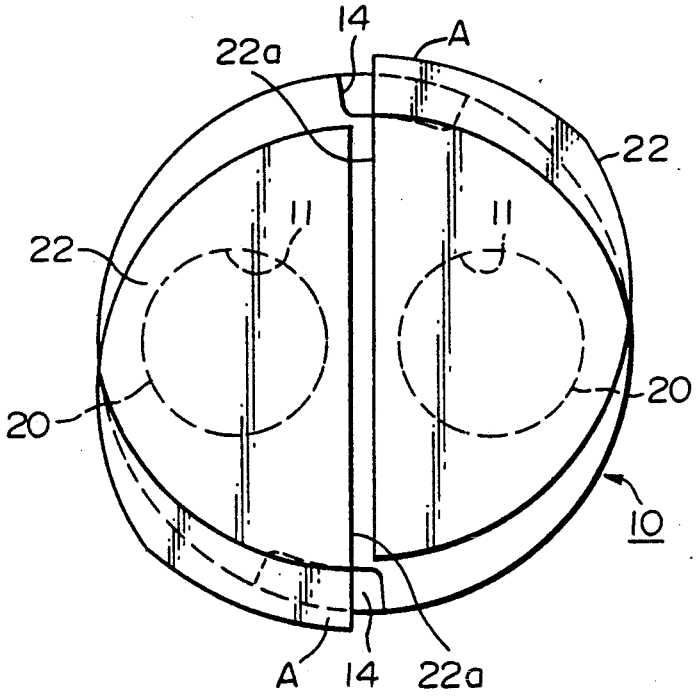
FIG. 20 is a plan view showing an outline of the blocks of FIG. 19 in which they have been retracted to an intermediate position.
Figure 21:
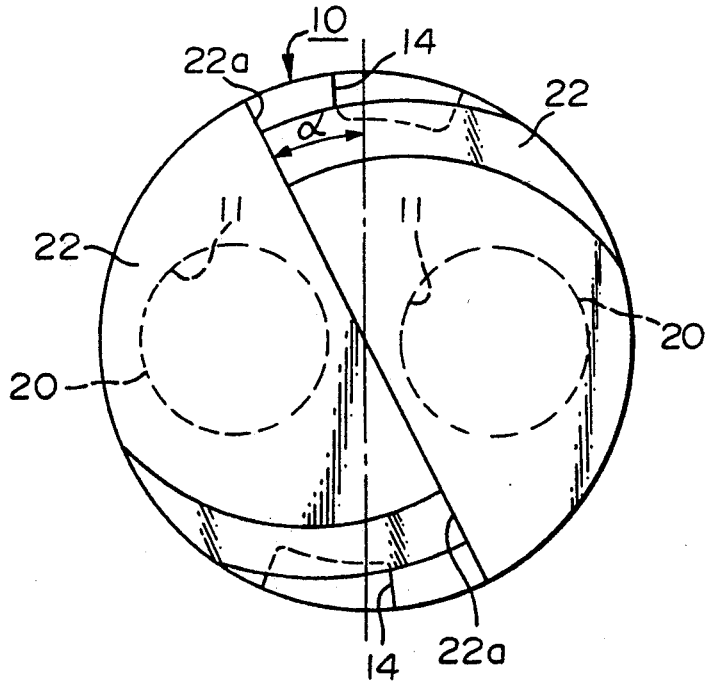
FIG. 21 is a plan view showing an outline of the blocks of FIG. 19 in which they have been fully retracted.

Next, the arrangement of blocks 22 will be explained in greater detail with reference to FIGS. 19 to 21.

Figure 19:
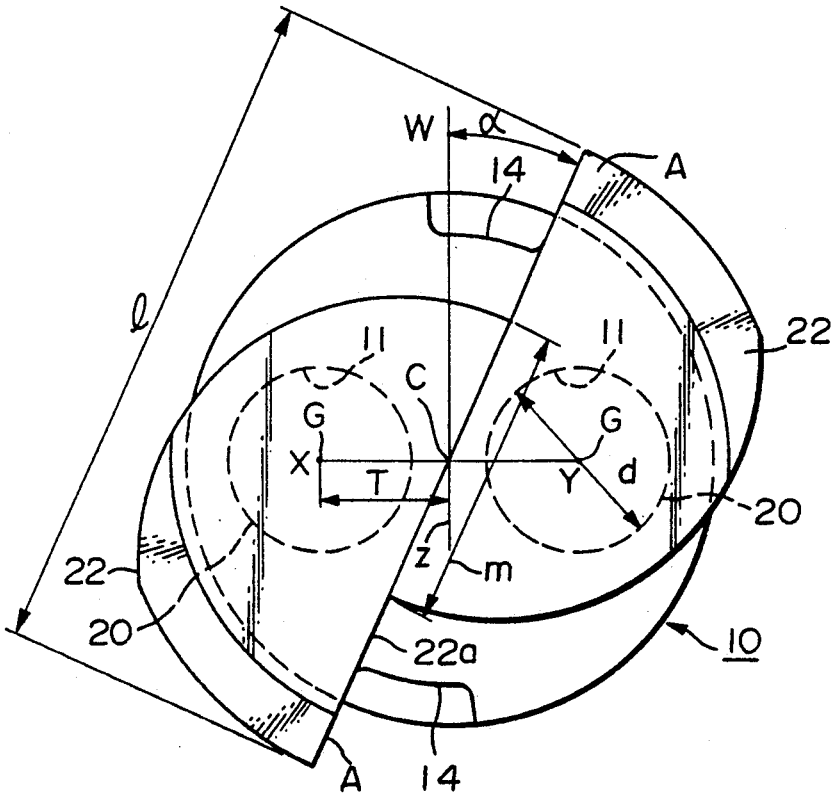
FIG. 19 is a plan view showing an outline of the extended state of the blocks of the first preferred embodiment.

In the present preferred embodiment, as shown in FIG. 19, it is a special characteristic that the ratio d/l of the inner diameter (d) of insertion holes 11 provided in the bottom surface of device 10 for the insertion of block axles 20 and the distance (l) between the block end parts at the time of the extension of the diameter of blocks 22 (the time when one of the straight edge parts 22*a* of the blocks 22 protrudes beyond the outer circumference of device 10 by a fixed amount) is established within a range of 0.22 to 0.34. Furthermore, in the embodiment, it is a special characteristic that the rotational angle alpha of blocks 22 is established within a range of from 10° to 35° with respect to the center line W of the line segment X-Y connecting the axial centers G of block axles 20. Furthermore, in the present preferred embodiment, as the block axles 20 are provided within the range described above, the positions of the centers of the insertion holes of block axles 20 in the bottom surface of the device are established within a range of (0.2–0.3)×(B) from the center of the device, where B is the diameter of the bottom surface of the device.

Here, the reason that the ratio (d/1) of inner diameter (d) of the insertion holes 11 of block axles 20 and distance (1) between block end parts at the time of the extension of the diameters is set at greater than 0.22 is that if the ratio (d/1) of inner diameter (d) of the insertion holes 11 of block axles 20 and distance (1) between block end parts at the time of the extension of the diameters is less than 0.22, the diameter of the block axles 20 becomes small, and the strength of the block axles 20 is lessened, so that block axles 20 are easily damaged. Furthermore, if the ratio (d/1) of inner diameter (d) of the insertion holes 11 of block axles 20 and distance (1) between block end parts at the time of the extension of the diameters is greater than 0.34, the strength of the block axles 20 can be increased, but as the inner diameter d of the insertion holes 11 increases, the thickness of the walls on the side of device 10 decrease, the durability of the device is adversely affected and the life of the tool is shortened.

Furthermore, the reason that the rotational angle alpha of blocks 22 is established within a range of from 10° to 35° with respect to the center line W of the line segment X-Y connecting the axial centers G of block axles 20 is that if the rotational angle alpha of blocks 22 is less than 10° with respect to the center line W of the line segment X-Y connecting the axial centers G of block axles 20, trouble such as the shrinking of blocks 22 can easily occur. In addition, if the rotational angle alpha of blocks 22 is greater than 35° with respect to the center line W of the line segment X-Y connecting the axial centers G of block axles 20, the length m of the surfaces of the straight edge surfaces of blocks 22 which are in contact becomes short, the overhang of the bits 21 becomes large, and this can cause the bending of the neck.

In addition, in the present preferred embodiment, the reason that the positions of the centers of the insertion holes of block axles 20 in the bottom surface of the device are established within a range of (0.2–0.3)×(B) from the center of the device, where B is the diameter of the bottom surface of the device, is as follows. If the positions of the centers are less than B×0.2 from the center of the device, the two block axles 20 will be too close to each other, so that the diameters of the block axles 20 will be small. Accordingly, they will be easily bendable. On the other hand, if the positions of the centers are more than B×0.3 from the center of the device, the distance between the outer circumference of the device and the insertion holes 11 will be too small, and the device itself will be easily damaged.

Next, the operation of an excavation tool with the above construction will be explained.

As shown in FIG. 4, etc., in order to attach blocks 22 to the bottom surface of device 10, first, block axles 20 and blocks 22 are made unitary, then straight edge surfaces 22*a* are placed in a mutually opposing fashion in insertion holes 11 of the bottom surface of the device 10, and block axles 20 are inserted. The engaging pin 17 is inserted into the pin hole 18 to engage block axles 20.

This assembly is simple in that block axles 20 are inserted into insertion holes 11 of device 10 and a engaging pin 17 is engaged therewith, so that two block axles 20 can be suspended; therefore, operations can be easily achieved.

In an excavation tool such as that described above, when the hammer cylinder receives the driving force and rotates in the direction shown by the arrow X, device 10, block axles 20 and blocks 22 also rotate in a unified fashion in the same direction.

Furthermore, when the hammer piston installed in the hammer cylinder is operated and impacts a downwardly compressive force to device 10, blocks 22 are pressed into the earth and bits 21 excavate earth and rock by means of rotational force.

When blocks 22 rotate in the direction of excavation with the hammer cylinder and device 10, blocks 22 rotate around block axles 20 by means of the resistance to excavation, one end of each of the straight edge surfaces of blocks 22 protrudes beyond the outer circumference of device 10, and this part functions as outer circumference cutting tool A.

Furthermore, when blocks 22 rotate, straight edge surfaces 22*a* of each block are in contact with each other, fulfilling the function of stoppers for rotation for each other, controlling the excess rotation of each block. By means of this function, blocks 22 receive the rotational force of device 10 and excavate earth by means of the outer circumference cutting tools A.

At this time, by means of the descent of the hammer piston, the compressed air flows from exhaust hole 15*a*, exits from air hole 15*c*, and the excavated material is expelled. A notched part 15*d* which communicates with discharge groove 14 is formed at the lead end of air hole 15*c*, so that a part of the compressed air flows directly in the direction shown by the arrows in FIG. 8, the expulsion of excavated material is thereby aided and the excavated material is therefore efficiently expelled.

Figure 16:
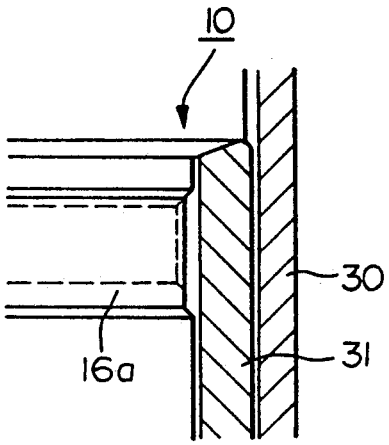
FIGS. 16 and 17 are cross-sectional views showing in detail the contacting portions of the device and the excavation pipe in the first preferred embodiment.
Figure 17:
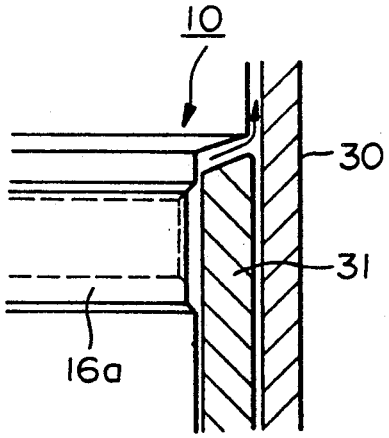
Figure 18:
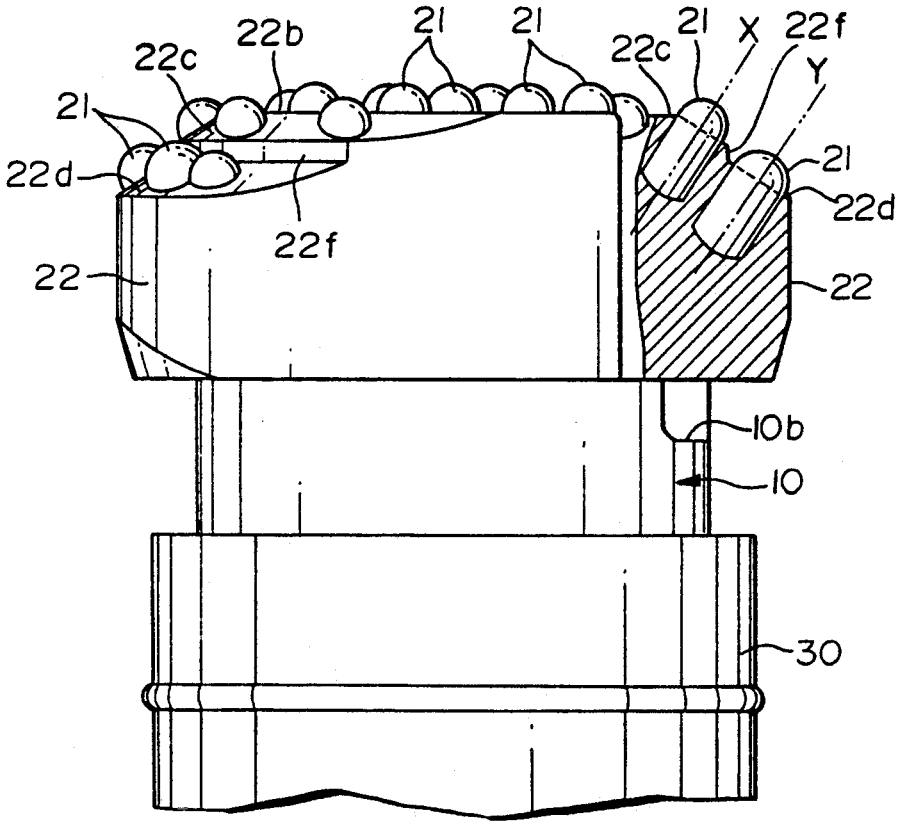
FIG. 18 is a side view in which a part of the block of the first preferred embodiment is shown in cross-section.

Furthermore, in the present preferred embodiment, as shown in FIGS. 16 and 17, when the hammer piston descends, a part of the compressed air passes through passage hole 16*b*, flows into circumferential groove 16*a* and discharged to the exterior, so that the excavated material is prevented from contacting the bottom surface (contact surface) of flange part 13, and an advantage is obtained in that the device contact surface is protected. Because the pressure of flows betweem the device 10 and block 22 purge the excavated material.

In addition, at the time of excavation, concave parts 22*f* are formed in blocks 22, and when the diameter of the blocks 22 is extended, a concavity 25 is formed in the center thereof, so that blocks 22 assume a form which will cut into rock strata when digging a hole and effective excavation in which shaking is rarely generated can be carried out. In addition, as shown in FIG. 11, the drive component force Fa generated by concavity 25 is operative in a radial direction and opposes force Fb, which operates on outer circumference cutting tools A. Therefore, the bending of the neck can be effectively prevented, and the life of the tool can be extended.

Furthermore, in the present embodiment, some of bits 21 set into the lead end surface of blocks 22 are positioned in the vicinity of the straight edge surfaces of the blocks 22 and set into the straight edge surfaces. In addition, among the bits 21 in the vicinity of the straight edge surfaces, the summits of the bits 21 which are positioned further towards the outer side than the outer circumference of one block 22 in the position in which one of the end parts of each of the blocks 22 protrudes beyond the outer circumference of the device by a fixed excavating amount are, as shown in FIG. 11, positioned to the outside of an extrapolated line A–B which extends along the curve of the outer surface of the blocks. Therefore, when excavating, in the case in which a shock force is imparted to block 22, the force can be borne in a radial direction of the device 10, and there is an advantage in that the force operating on outer circumference cutting tools A can be borne. Moreover, it is possible to cause the bits 21 along the extrapolated line A–B to operate towards the outside, so that wear can be reduced, and the life of the tool can be extended.

Furthermore, when the piston within the hammer cylinder escends, the compressed air pushed out by the hammer piston flows into exhaust hole 15*a* and is expelled from flow hole 16*c* by means of passage hole 15*b*, so that even if problems which block air hole 15*c*, such as the presence of sludge layers or other causes, occur, the compressed air is expelled from flow hole 16*c*, and therefore the operation of the piston does not cease, the digging operation is not affected, and the operational efficiency can be increased.

In addition, by means of excavation such as that above, the bottom surface of the device is reduced by means of the striking thereon, or the length dimension of the device becomes shorter than it originally was as a result of reprocessing attributable to the damage to the striking surface. However, in the present embodiment, the notched part 22*a* into which engaging pin 17 is inserted is formed longer in an axial direction of block axles 20 than the diameter of engaging pin 17, so that even in the case in which the length dimension of device 10 becomes short, the shear force acting on engaging pin 17 does not become large, and it is possible to prevent the bending of engaging pin 17(see FIG. 9).

Moreover, in the present embodiment, as the construction is such that notched part 22*a* is only cut in the area of rotation of block axle 20, the cross-sectional loss of block axle 20 is decreased, and it is possible to increase the strength of block axle 20 thereby.

Furthermore, in the present embodiment, a flange part 30 which is in contact with the lead end of excavation pipe 30 is provided at the outer circumference of fastening pipe 31, and the flange part 30 and the lead end of the excavation pipe 30 are welded along the entire circumference thereof. Furthermore, notch hole 31*b*, which extends in an axial direction of fastening pipe 31 and communicates the inside and outside of the fastening pipe 31 is formed therein, and through the medium of the notch hole 31*b*, the fastening pipe 31 and the excavation pipe 30 are welded, so that the fastening pipe 31 and the excavation pipe 30 can be fastened together in a strong, unitary manner. In particular, by welding fastening pipe 31 at the position of notch hole 31*b*, which communicates the inside and outside of fastening pipe 31, a tight attachment is generated at this position by means of the weld, and it is possible to attach fastening pipe 31 and excavation pipe 30 with better strength.

After the cessation of excavation, the hammer cylinder is rotated in the opposite direction of the direction of rotation, but at this time each block 22 rotates in the opposite direction of that during excavation, and as shown in FIG. 11, arc parts 22*b*, which are positioned at the extreme outer circumference of blocks 22, are at the same position as the bottom surface of device 10 or are on the inside thereof.

In this way, it is possible to slide along the inside of excavation pipe 30, so that if the hammer cylinder is drawn upward, the excavation tool can be removed.

At the time of a reduction in diameter of blocks 22 such as that above, the air hole 15*c* in the bottom surface of the device is temporarily blocked by the blocks 22 during the reduction in diameter of the blocks 22; however, as notch hole 15*d*, which opens in the side surface of device 10, is formed at the lead end of air hole 15*c*, compressed air can be expelled to the outside through notch hole 15*d*. Furthermore, by expelling compressed air onto the contact surfaces between the device and the blocks, excavated material on these contact surfaces can be effectively eliminated, and the resistance to the retraction of the blocks can be eliminated.

Furthermore, in the present embodiment, a contact part 22*h* which makes contact with the bottom surface of device 10 and the upper surface of blocks 22 is provided at the center of blocks 22, and an pre-lowered part 22*i* is formed at the outer circumference of contact part 22*h* and one level lower than contact part 22*h*. Furthermore, between contact part 22*h* and pre-lowered part 22*i*, there is an angled surface 22*j*, the beginning edge of which is at the same height as contact part 22*h* and the ending edge of which is at the same height as pre-lowered part 22*i*, so that when blocks 22 are retracted and drawn up within excavation pipe 30, the blocks can be easily drawn upward along the angled surface, and therefore the blocks are easily retractable and can easily enter the excavation pipe. In addition, even if burrs or the like are created on contact surface 22*h* as a result of the impact during excavation at the entended state, as pre-lowered part 22*i* is formed one level lower than contact part 22*h*, the withdrawal of blocks 22 is not hindered, because and the operational qualities at the work site are improved.

Furthermore, in the present preferred embodiment, a step 22*f* provided between a first sloping surface 22*c*, which is inclined with a downward slope in the direction of the outer circumference of device 10 from the arc-shaped ridge line of the level surface 22*b* of the block lead end, and a second sloping surface 22*d*, which is inclined with a downward slope in the direction of the outer circumference of device 10 from the arc-shaped ridge line of the outer side of this first sloping surface 22*c*. Thus, it is possible to maintain the spacing between bits 21 which are set into these sloping surfaces 22*c* and 22*d*, so that it becomes possible to use a large number of bits, and the efficiency of excavation can be increased.

Next, the effect of the characteristic arrangement of the block axles in accordance with the present preferred embodiment will be explained.

The ratio (axial diameter ratio) (d/l) of the inner diameter (d) of insertion holes 11 of block axles 20 which are provided in the bottom surface of device 10 and the length (l) between block end parts at the time of the extension of the diameter of blocks 22 (when one end of each of the straight edge surfaces 22*a* of blocks 22 projects beyond the outer circumference of device 10 by a fixed amount) was tested by the digging of six-inch wells using devices 10, block axles 20 and blocks 22 created according to the specifications of the table on FIG. 22.

As is clear from the results of these tests, the results of the digging exceeded 90 meters when the axial diameter ratio was within a range of 0.22–0.34; outside this range, the results were less than 50 meters, and problems such as the bending of the neck occurred. By "bending of the neck" is meant the bending of block axles 20 so that they are no longer functional(see FIG. 22).

SECOND PREFERRED EMBODIMENT

Figure 23:
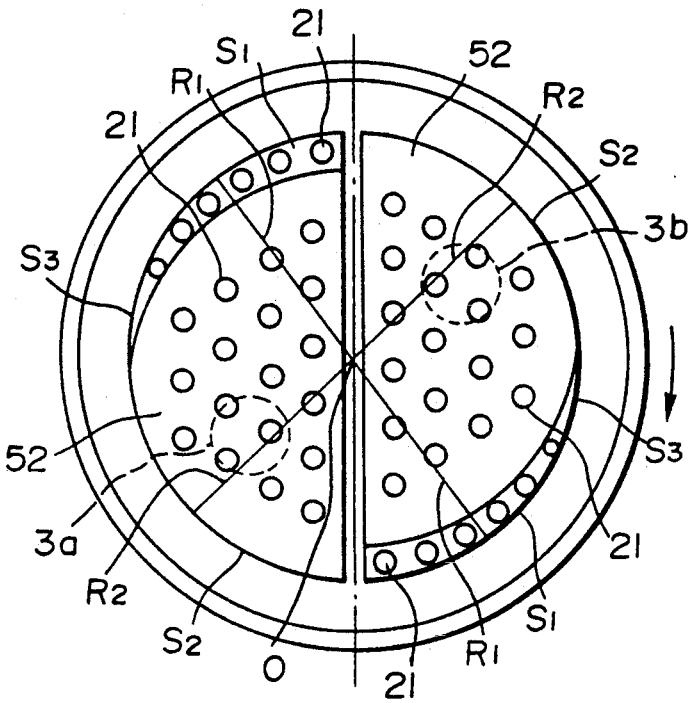
FIG. 23 is a plan view showing the retracted state of the blocks of the second preferred embodiment.
Figure 24:
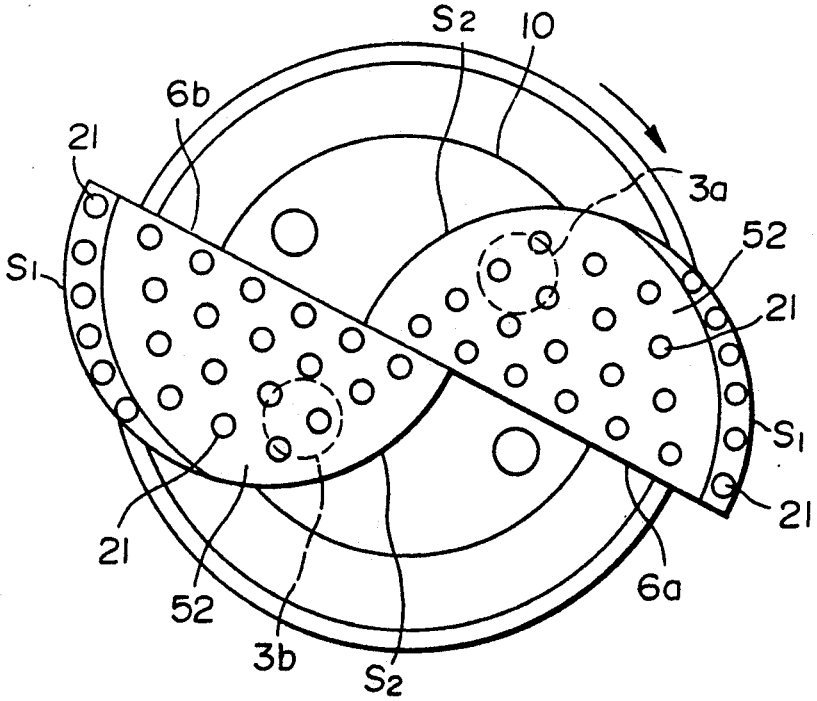
FIG. 24 is a plan view showing the extended state of the blocks of the second preferred embodiment.

FIGS. 23 and 24 show a second preferred embodiment of the present invention. In these figures, reference numeral 52 indicates a pair of blocks. These blocks 52 each have a roughly semicircular shape when viewed from the bottom surface side thereof, roughly same as the first preferred embodiment, and the outer circumferences thereof are formed with arcs with differing radii.

That is, the outer circumferences of the blocks 52 comprise two arcs $S_1$ and $S_2$ and curves $S_3$ which smoothly connect arcs $S_1$ and $S_2$. Arcs $S_1$ and $S_2$ are arcs centered on point 0 with differing radii $R_1$ and $R_2$; $R_1 > R_2$. Furthermore, arc $S_1$ is position on the side which projects beyond the outer circumference of the device when device 10 rotates in the direction of excavation; arc $S_2$ is on the side which does not so project.

A plurality of bits 21 . . . are set into the lead end surface of the blocks 52, but the radius $R_1$ of the outer circumference of the part on the projecting side is larger than radius $R_2$ of the outer circumference of the part on the non-projecting side, so that a plurality of bits 21 . . . can be set into the part on the projecting side.

Accordingly, when device 10 rotates in the direction of excavation, even if the amount of work of the parts of blocks 52 which project is large, a plurality of bits 21 . . . are set into this part, so that it is possible to prevent the situation in which the bits 21 . . . on the projecting side wear out before the bits 21 . . . on the non-projecting side, and thus to extend the life of the excavation tool in comparison with conventional excavation tools.

THIRD PREFERRED EMBODIMENT

Figure 25:
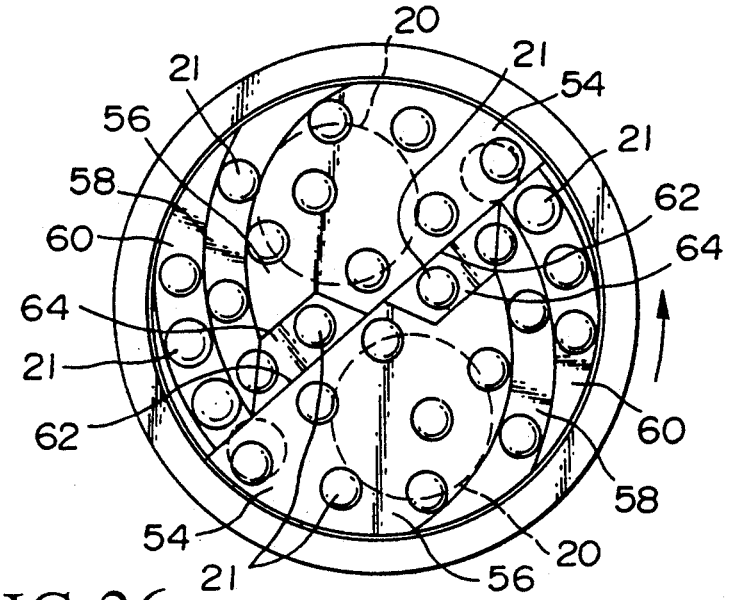
FIG. 25 is a plan view showing the retracted state of the blocks of the third preferred embodiment.
Figure 26:
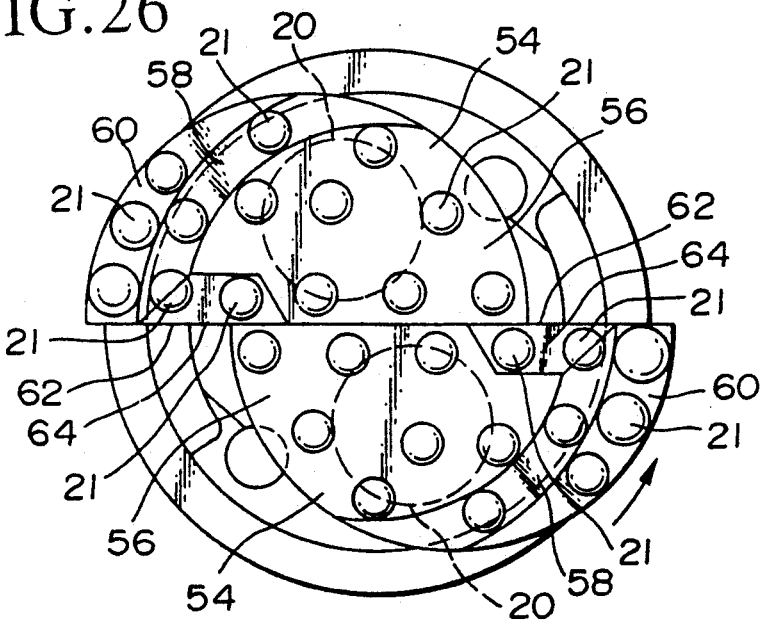
FIG. 26 is a plan view showing the extended state of the blocks of the third preferred embodiment.
Figure 27:
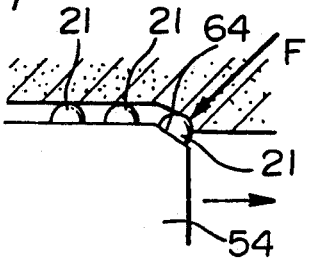
FIG. 27 is a cross-sectional view showing a part of the blocks of the third preferred embodiment in the excavation state.

FIGS. 25 to 27 show a third preferred embodiment of the present invention. In these diagrams, reference numeral 54 indicates a pair of blocks. These blocks 54 each have a roughly semicircular shape when viewed from the bottom surface side thereof, roughly same as the first preferred embodiment. The lead edge surfaces (bottom surfaces) hereof comprise level surfaces 56, which are positioned on the side of block axles 20 and are perpendicular to these block axles; surfaces 58, which slope toward the axial direction base end side of device 10 as they extend from the arc-shaped ridge line of level surfaces 56 in the direction of the outer circumference of device 10; surfaces 60, which slope toward the axial direction base end side of device 10 as they extend from the outer side arc- shaped ridge line of surfaces 58 in the direction of the outer circumference of device 10; and sloping surfaces 64, which are formed at the end part of straight edge surfaces 62 of blocks 22 which project beyond the outer circumference of device 10 when device 10 rotates in the direction of excavation and gradually slope toward the axial direction base end side of device 10 as they proceed in the direction of rotation. The angle of inclination of these sloping surfaces 64 with respect to the vertical axis is set at 45° in this preferred embodiment; however, this angle of inclination is not so limited, but can rather be set in accordance with the shape and size of block 54, rotational speed of device 10, etc.

A plurality of bits 21 . . . comprising superhard chips are set into level surfaces 56, surfaces 58, and surfaces 60 in a vertical manner with respect to the surfaces, and a plurality of bits 21 . . . are also set into sloping surfaces 64 in a vertical manner with respect to the sloping surfaces 64.

In an excavation tool such as that described above, when device 10 is rotated in the direction of excavation, blocks 54 rotate about block axles 20, and sloping surfaces 64, which are formed at one end of each of the straight edge surfaces 62 of blocks 54, project beyond the outer circumference of device 10. In addition, a part of straight edge surfaces 62 are in contact with each other, stopping the rotation of blocks 54; in this state, blocks 54 receive the rotational force of device 10 and excavate earth by means of bits 21 . . . , and furthermore, proceed through the earth by means of the impact force of the hammer.

At this time, as shown in FIG. 27, the combined force F of the rotational counterforce and the counterforce of the impact force which is perpendicular to the rotational counterforce acts on the bits 21 . . . which are set into sloping surfaces 64 in the most inclined manner with respect to the vertical axis. However, as these bits 21 . . . are set into sloping surfaces 64 in a nearly vertical manner, the combined force F acts nearly vertically with respect to bits 21 . . . , as shown, thus damage and detachment are prevented.

In the first to third preferred embodiments described above, the use either of a construction in which the block axles and the blocks are formed in a unified manner or a construction in which they are formed separately and then joined is acceptable.

FOURTH PREFERRED EMBODIMENT

Next, a fourth preferred embodiment which is ideal for the case in which the block axles and the blocks are formed separately and then joined together will be explained.

Figure 28:
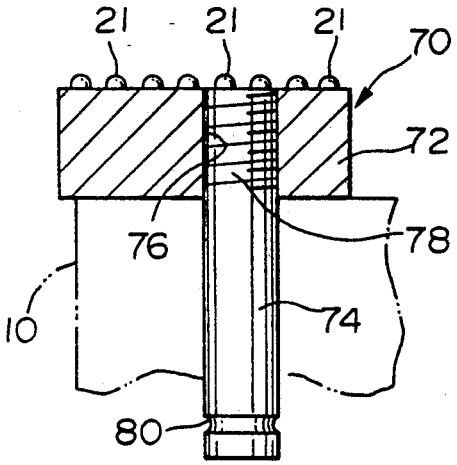
FIG. 28 is a cross-sectional view of the blocks and block axles of the fourth preferred embodiment.
Figure 29:
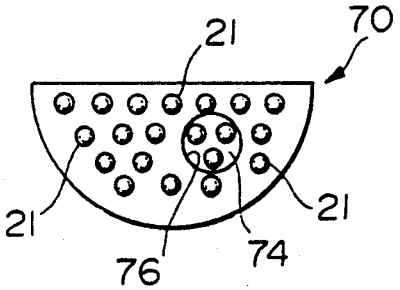
FIG. 29 is a plan view of the blocks and block axles of the fourth preferred embodiment.

FIGS. 28 and 29 show a fourth preferred embodiment of the present invention. In these diagrams, reference numeral 70 indicates an excavation head. This excavation head 70 comprises primarily block 72 and block axle 74, which is attached to this block 72.

This block 72 has a plate form with a roughly semicircular shape when viewed from the top surface side thereof; a plurality of bits 21 . . . comprising superhard chips or the like are set into the upper surface thereof. Furthermore, a screw hole 76 which communicates the upper and lower surfaces of block 72 is formed in block 72.

On the other hand, block axle 74 has a cylindrical pillar shape; bits 21 are set into the lead end surface thereof. In addition, a male screw thread 78 which screws into screw hole 76 is formed on the lead end outer circumference of block axle 74, and a groove 80, into which a pin is placed which serves the purpose of preventing the removal from the device 10, is formed in the base end outer circumference along this circumference.

In addition, excavation head 70 is formed by the insertion of block axle 74 into screw hole 76 of block 72 and the screwing of male screw thread 78 formed on the lead end outer circumference of block axle 74 into this screw hole 76.

In accordance with an excavation tool such as that described above, excavation head 70 is formed with a dismemberable construction comprising block 72 and block axle 74 which is attached to block 72 by being screwed thereinto; therefore, when excavation head 70 is manufactured, it is possible to manufacture block 72 and block axle 74 separately. Accordingly, the difficulties which arise in the manufacture of a conventional excavation part which is formed with only one part are solved, so that the production cost of the excavation tool can be held down as a result.

FIFTH PREFERRED EMBODIMENT

Figure 31:
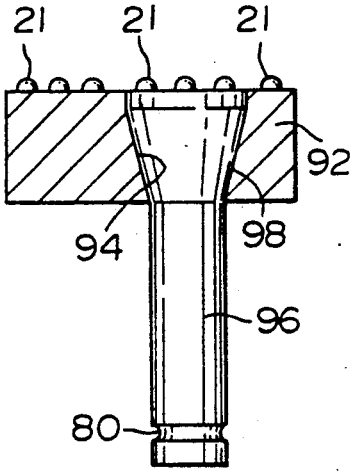
FIG. 31 is a cross-sectional view of the blocks and block axles of the sixth preferred embodiment.

FIG. 31 shows a fifth preferred embodiment of the present invention. The fifth preferred embodiment shown in the diagram is a modification of the construction of the fourth preferred embodiment in which block 82 and block axle 84 are joined by being tightly fitted together.

In accordance with the excavation tool according to the present preferred embodiment, it is not necessary to form screw threads on block 82 and block axle 84 as in the case of the fourth preferred embodiment, so that the manufacture of block 82 and block axle 84 becomes simple.

SIXTH PREFERRED EMBODIMENT

FIG. 31 shows a sixth preferred embodiment of the present invention. The sixth preferred embodiment shown in the diagram is a modification of the construction of the fifth preferred embodiment in which a tapered hole 94 which gradually widens in the direction of the lead end surface is formed in block 92. A tapered part 98 which fits tightly into the tapered hole 94 is formed at the lead end side of block axle 96.

In accordance with the excavation tool according to the present preferred embodiment, the accuracy and strength of attachment of block axle 96 and block 92 is improved in comparison with the case of the fifth preferred embodiment.

SEVENTH PREFERRED EMBODIMENT

Figure 32:
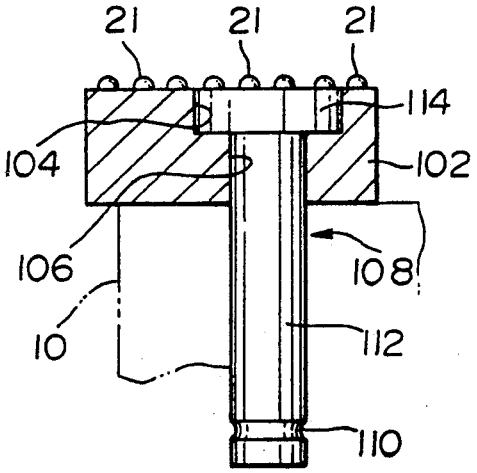
FIG. 32 is a cross-sectional view of the blocks and block axles of the seventh preferred embodiment.
Figure 30:
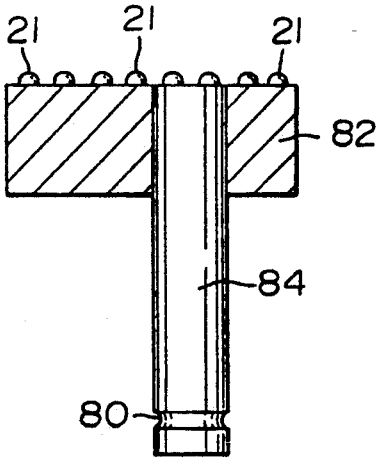
FIG. 30 is a cross-sectional view of the blocks and block axles of the fifth preferred embodiment.

FIG. 32 shows a seventh preferred embodiment of the present invention. The seventh preferred embodiment shown in the diagram is a modification of the construction of the fifth preferred embodiment.

A hole 104 which is circular and has a depth of roughly ⅓ of the depth of block 102 is formed in the lead end surface of block 102; a hole 106 which opens in the bottom end surface of block 102, has the same axis as hole 104 and a smaller diameter than hole 104 is formed below hole 104.

Block axle 108, which is joined to block 102, comprises axle part 112, which has a cylindrical pillar shape and a groove 110 formed in the base end outer circumference thereof, and head part 114, which is formed at the lead end part of axle part 112 and has a larger diameter than axle part 112.

Block 102 is affixed by the insertion of axle part 112 of block axle 108 into hole 106 and the fitting of head part 114 of block axle 108 into hole 104 of block 102.

In accordance with the excavation tool of the present invention, block 102 is sandwiched between head part 114 of block axle 108 and the bottom surface of device 10, so that there is no need to form screw threads of the type of the fourth preferred embodiment between the axle part 112 of the block axle 108 and hole 104 of block 102, nor is there a need to conduct manufacture by using tight fitting of the type of the fifth preferred embodiment.

EIGHTH PREFERRED EMBODIMENT

Figure 33:
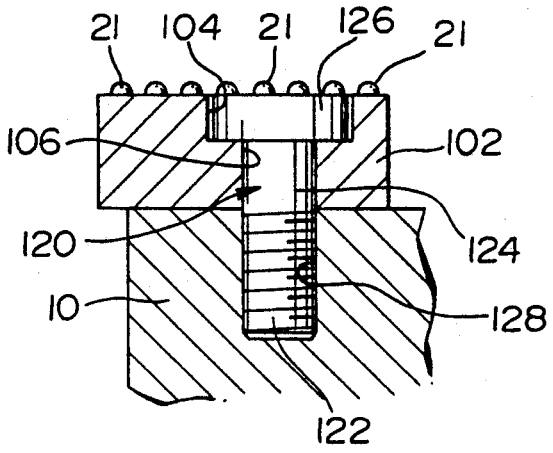
FIG. 33 is a cross-sectional view of the blocks and block axles of the eighth preferred embodiment.

FIG. 33 shows an eighth preferred embodiment of the present invention. The excavation tool shown in the diagram comprises block 102 and block axle 120, as in the case of the seventh preferred embodiment.

Block axle 120 comprises axle part 124, which has a screw thread 122 formed on the base end outer circumference thereof and is inserted in a freely sliding manner into hole 106 of block 102, and head part 126, which is formed at the lead end part of axle part 124, has a larger diameter than axle part 124, and fits in a freely sliding manner into hole 104 of block 102.

Axle part 124 of block axle 120 is inserted through hole 106 of block 102, and head part 126 of block axle 120 is fitted into hole 104 of block 102. Furthermore, axle part 124 is attached by screwing screw part 122 into screw hole 128, which is formed in the bottom surface of device 10; when device 10 is rotated in the direction of excavation, block 102 rotates about block axle 120 and protrudes by a fixed amount beyond the outer circumference of device 10.

In this preferred embodiment, block axle 120 is screwed tightly into device 10, so that no shaking occurs in block axle 120 or block 102.

NINTH PREFERRED EMBODIMENT

Figure 34:
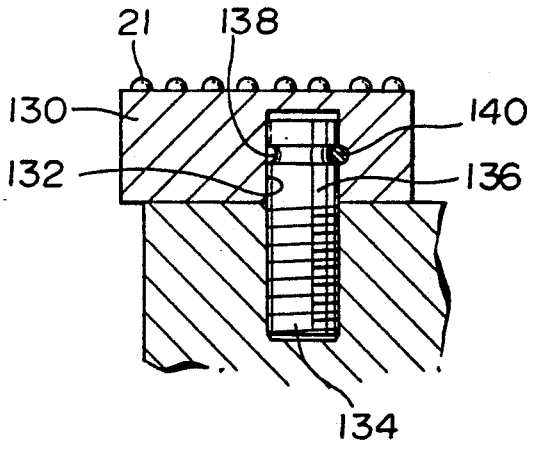
FIG. 34 is a cross-sectional view of the blocks and block axles of the ninth preferred embodiment.

FIG. 34 shows an ninth preferred embodiment of the present invention. In the excavation tool shown in the diagram, a hole 132 which does not extend to the lead end surface of block 130 is formed in the base end surface of block 130, and the lead end part of block axle 136, which has a cylindrical pillar form and on the base end outer circumference of which is formed male screw thread 134, is inserted into hole 132. A groove 138 is formed along the circumference of this lead end part, and a pin 140 is inserted joiningly through a pin hole formed in block 130 into this groove 138. Thus block 130 is prevented from detaching from block axle 106 by means of pin 140, and block 130 is made rotatable about block axle 136.

In the excavation tool according to the present preferred embodiment, block axle 136 is not exposed on the lead end surface of block 130, so that wear as a result of contact with excavated material can be prevented.

In the excavation tools of the fourth and ninth preferred embodiments above, the blocks and block axles are formed as separate parts. By precisely combining the materials which comprise these parts, it is possible to increase the dependability of the tool.

The following are examples of the qualities required for the blocks.

(1) They should not wear down quickly as a result of contact with rock layers in the earth (resistance to wear).

(2) As it is necessary to form a number of holes for the setting of the bits, they should be machine-manufactureable (machine manufacturability).

In contrast, in comparison with the blocks themselves, the block axles rarely come into contact with rock, and so a low resistance to wear is permissible. Furthermore, the block axles have a simple shape in comparison with the blocks, so that poor machine-manufacturability is also acceptable. However, as the block axles are repeatedly deformed by excavation, a high fatigue strength is necessary. Accordingly, in the blocks, in order to achieve ideal resistance to wear, hardened, tempered materials are generally used, and in the block axles, in order to raise fatigue strength, it is preferable to use surface-hardened materials in which the surface alone has been hardened by means of a carburizing process or the like.

For example, the blocks are formed by steel which contains nickel, chromium, molybdenum, and has a high carbon content and subjecting this to a hardening and temperizing process, and the block axles are formed by steel which contains nickel, chromium, molybdenum, and has a low carbon content and subjecting this to carburization.

What is claimed is:

1. An excavation tool, having a pair of insertion holes placed in a bottom surface of a device, which receives an impact force of a hammer and a rotational force of a hammer cylinder, at positions separated in a radial direction from a center of said device and symmetrical around said center as a center of rotation;

a pair of block axles, one end of each of which is freely rotatably inserted into one of said insertion holes;

a pair of blocks, which have a roughly semicircular shape with a diameter roughly equal to that of said device, into lead end surfaces of which are set bits, and which have straight edge surfaces which are flat surfaces vertical with respect to said lead end surfaces, provided at another end of said block axles and with said straight edge surfaces in mutual opposition;

in an extended diameter state of which said blocks are moved in opposite directions along a radius of said device by means of rotating said blocks around said block axles; and in which a distance between centers of said insertion holes provided in said bottom surface of said device and said center of said device is set at from 0.2 times a diameter of said bottom surface of said device to 0.3 times thereof.

2. An excavation tool, having a pair of insertion holes placed in a bottom surface of a device, which receives an impact force of a hammer and a rotational force of a hammer cylinder, at positions separated in a radial direction from a center of said device and symmetrical around said center as a center of rotation;

a pair of block axles, one end of each of which is freely rotatably inserted into one of said insertion holes;

a pair of blocks, which have a roughly semicircular shape with a diameter roughly equal to that of said device, into lead end surfaces of which are set bits, and which have straight edge surfaces which are flat surfaces vertical with respect to said lead end surfaces, provided at another end of said block axles and with said straight edge surfaces in mutual opposition;

in an extended diameter state of which said blocks are moved in opposite directions along a radius of said device by means of rotating said blocks around said block axles; and in which a ratio (d/1) between an inner diameter (d) of said insertion holes provided in said bottom surface of said device and a distance (1) between block ends in said extended diameter state is set within a range of from 0.22 to 0.34.

3. An excavation tool in accordance with claim 2, in which a length dimension of said block axles is set within a range of from 1.5 times an outer diameter of said block axles to 2.5 times thereof.

4. An excavation tool, having a pair of insertion holes placed in a bottom surface of a device, which receives an impact force of a hammer and a rotational force of a hammer cylinder, at positions separated in a radial direction from a center of said device and symmetrical around said center as a center of rotation;

a pair of block axles, one end of each of which is freely rotatably inserted into one of said insertion holes;

a pair of blocks, which have a roughly semicircular shape with a diameter roughly equal to that of said device, into lead end surfaces of which are set bits, and which have straight edge surfaces which are flat surfaces vertical with respect to said lead end surfaces, provided at another end of said block axles and with said straight edge surfaces in mutual opposition;

in an extended diameter state of which said blocks are moved in opposite directions along a radius of said device by means of rotating said blocks around said block axles; and in which a rotational angle of said blocks is set within a range of from 10 degrees to 35 degrees with respect to a line segment perpendicular to a line segment connecting centers of said block axles at a center thereof.

5. An excavation tool, having a pair of insertion holes placed in a bottom surface of a device, which receives an impact force of a hammer and a rotational force of a hammer cylinder, at positions separated in a radial direction from a center of said device and symmetrical around said center as a center of rotation;

a pair of block axles, one end of each of which is freely rotatably inserted into one of said insertion holes;

a pair of blocks, which have a roughly semicircular shape with a diameter roughly equal to that of said device, into lead end surfaces of which are set bits, and which have straight edge surfaces which are flat surfaces vertical with respect to said lead end surfaces, provided at another end of said block axles and with said straight edge surfaces in mutual opposition;

in an extended diameter state of which said blocks are moved in opposite directions along a radius of said device by means of rotating said blocks around said block axles; and in which sloping surfaces are provided inclined with respect to said straight edge surfaces and said lead end surfaces at an intersection part of said straight edge surfaces and said lead end surfaces, and some of said bits are set into said sloping surfaces vertically with respect to said sloping surfaces.

6. An excavation tool, having a pair of insertion holes placed in a bottom surface of a device, which receives an impact force of a hammer and a rotational force of a hammer cylinder, at positions separated in a radial direction from a center of said device and symmetrical around said center as a center of rotation;

a pair of block axles, one end of each of which is freely rotatably inserted into one of said insertion holes;

a pair of blocks, which have a roughly semicircular shape with a diameter roughly equal to that of said device, into lead end surfaces of which are set bits, and which have straight edge surfaces which are flat surfaces vertical with respect to said lead end surfaces, provided at another end of said block axles and with said straight edge surfaces in mutual opposition; in an extended diameter state of which said blocks are moved in opposite directions along a radius of said device by means of rotating said blocks around said block axles; and in which the outer circumference of said blocks comprises a cylindrical surface with a diameter roughly equal to that of said device, and a cylindrical surface with a greater diameter; said cylindrical surface with a greater diameter is provided within such a range that it does not overlap said device in said extended diameter state of said blocks.

7. An excavation tool, having a pair of insertion holes placed in a bottom surface of a device, which receives an impact force of a hammer and a rotational force of a hammer cylinder, at positions separated in a radial direction from a center of said device and symmetrical around said center as a center of rotation;

a pair of block axles, one end of each of which is freely rotatably inserted into one of said insertion holes;

a pair of blocks, which have a roughly semicircular shape with a diameter roughly equal to that of said device, into lead end surfaces of which are set bits, and which have straight edge surfaces which are flat surfaces vertical with respect to said lead end surfaces, provided at another end of said block axles and with said straight edge surfaces in mutual opposition;

in an extended diameter state of which said blocks are moved in opposite directions along a radius of said device by means of rotating said blocks around said block axles; and in which said block axles and said blocks are joined in a separable manner.

8. An excavation tool in accordance with claim 7, in which said block axles and said blocks are formed of differing materials.

9. An excavation tool, having a pair of insertion holes placed in a bottom surface of a device, which receives an impact force of a hammer and a rotational force of a hammer cylinder, at positions separated in a radial direction from a center of said device and symmetrical around said center as a center of rotation;

a pair of block axles, one end of each of which is freely rotatably inserted into one of said insertion holes; a pair of blocks, which have a roughly semicircular shape with a diameter roughly equal to that of said device, into lead end surfaces of which are set bits, and which have straight edge surfaces which are flat surfaces vertical with respect to said lead end surfaces, provided at another end of said block axles and with said straight edge surfaces in mutual opposition;

in an extended diameter state of which said blocks are moved in opposite directions along a radius of said device by means of rotating said blocks around said block axles; and in which, in a surface of said blocks on the side of said device, a part of said surface which projects beyond an outer circumference of said device and does not overlap said bottom surface of said device in said extended diameter state of said blocks is separated further from said device than a part of said surface which overlaps said bottom surface of said device in said extended diameter state of said blocks.

10. An excavation tool in accordance with claim 9, in which a sloping surface which is inclined with respect to both said part of said surface of said blocks on the side of said device which overlaps said device and said part which does not overlap is provided between these parts.

11. An excavation tool, having a pair of insertion holes placed in a bottom surface of a device, which receives an impact force of a hammer and a rotational force of a hammer cylinder, at positions separated in a radial direction from a center of said device and symmetrical around said center as a center of rotation;

a pair of block axles, one end of each of which is freely rotatably inserted into one of said insertion holes;

a pair of blocks, which have a roughly semicircular shape with a diameter roughly equal to that of said device, into lead end surfaces of which are set bits, and which have straight edge surfaces which are flat surfaces vertical with respect to said lead end surfaces, provided at another end of said block axles and with said straight edge surfaces in mutual opposition;

in an extended diameter state of which said blocks are moved in opposite directions along a radius of said device by means of rotating said blocks around said block axles; and in which some of said bits are positioned in the lead surfaces of said blocks vicinity of said straight edge surfaces and along said straight edge surfaces, and summits of bits positioned in the vicinity of said straight edge surfaces in a part which does not overlap in said extended diameter state are positioned to the outside of of an extrapolated line which extends along a curve of an arc of an outer surface of a block opposite to that of said bits.

12. An excavation tool, having a pair of insertion holes placed in a bottom surface of a device, which receives an impact force of a hammer and a rotatational force of a hammer cylinder, at positions separated in a radial direction from a center of said device and symmetrical around said center as a center of rotation;

a pair of block axles, one end of each of which is freely rotatably inserted into one of said insertion holes;

a pair of blocks, which have a roughly semicircular shape with a diameter roughly equal to that of said device, into lead end surfaces of which are set bits, and which have straight edge surfaces which are flat surfaces vertical with respect to said lead end surfaces, provided at another end of said block axles and with said straight edge surfaces in mutual opposition;

in an extended diameter state of which said blocks are moved in opposite directions long a radius of said device by means of rotating said blocks around said block axles; and in which semicircular indented parts indented in a same side of each of said blocks are provided in said lead end surfaces of said blocks, and said indented part of each block is positioned at such a position that said indented part is offset from a center of a semicircle formed by said block at a distance roughly equal to a distance of radial movement of said block as a result of an extension of said diameter.

13. An excavation tool, having a pair of insertion holes placed in a bottom surface of a device, which receives an impact force of a hammer and a rotational force of a hammer cylinder, at positions separated in a radial direction from a center of said device and symmetrical around said center as a center of rotation;

a pair of block axles, one end of each of which is freely rotatably inserted into one of said insertion holes;

a pair of blocks, which have a roughly semicircular shape with a diameter roughly equal to that of said device, into lead end surfaces, of which are set bits, and which have straight edge surfaces which are flat surfaces vertical with respect to said lead end surfaces, provided at another end of said block axles and with said straight edge surfaces in mutual opposition;

in an extended diameter state of which said blocks are moved in opposite directions along a radius of said device by means of rotating said blocks around said block axles; and in which said lead end surfaces of said blocks are provided with:

a level surface, which is positioned near the block axles and is perpendicular to said block axles;

a first sloping surface, which is downwardly inclined in a direction of an outer circumference side of said device from an arc-shaped ridge of said level surface; and a second sloping surface, which is downwardly inclined in a direction of an outer circumference side of said device from an arc-shaped ridge of an outer side of said first sloping surface, and a difference in level is provided between said first sloping surface and said second sloping surface.

* * * * *

UNITED STATES PATENT AND TRADEMARK OFFICE

CERTIFICATE OF CORRECTION

PATENT NO. : 5,113,954

DATED : May 19, 1992

INVENTOR(S) : Takeshi Hayashi, et al.

It is certified that error appears in the above-identified patent and that said Letters Patent is hereby corrected as shown below:

Column 6, line 19: "along" should read as --alone--

Column 14, line 30: "106" should read as --136--

Column 18, line 40, Claim 12: "rotatational" should read as --rotational--

Column 18, line 56, Claim 12: "long a" should read as -- along a --.

Signed and Sealed this

Ninth Day of November, 1993

*Attest:*

*Attesting Officer*

BRUCE LEHMAN

*Commissioner of Patents and Trademarks*